US010783753B2

(12) United States Patent
Crawford, III et al.

(10) Patent No.: US 10,783,753 B2
(45) Date of Patent: Sep. 22, 2020

(54) ELECTRONIC GAMING TABLE WITH VIRTUAL PLAYING CARD MASKING SYSTEM

(71) Applicants: James Thomas Crawford, III, Charlotte, NC (US); Gehrig H. White, Charlotte, NC (US); Kendal Ferner, Charlotte, NC (US); Lyle Arnold Berman, Las Vegas, NV (US)

(72) Inventors: James Thomas Crawford, III, Charlotte, NC (US); Gehrig H. White, Charlotte, NC (US); Kendal Ferner, Charlotte, NC (US); Lyle Arnold Berman, Las Vegas, NV (US)

( * ) Notice: Subject to any disclaimer, the term of this patent is extended or adjusted under 35 U.S.C. 154(b) by 292 days.

(21) Appl. No.: 15/959,186

(22) Filed: Apr. 21, 2018

(65) Prior Publication Data

US 2019/0325708 A1 Oct. 24, 2019

(51) Int. Cl.

| | |
|---|---|
| ***A63F 1/06*** | (2006.01) |
| ***A63F 9/24*** | (2006.01) |
| ***G07F 17/32*** | (2006.01) |

(52) U.S. Cl.

CPC ..... *G07F 17/3293* (2013.01); *A63F 1/067* (2013.01); *A63F 9/24* (2013.01); *A63F 2009/2445* (2013.01); *A63F 2300/66* (2013.01)

(58) Field of Classification Search

CPC ..... G02F 1/133509; A63F 2300/203; G07F 17/3211; G07F 17/3293

See application file for complete search history.

(56) References Cited

U.S. PATENT DOCUMENTS

| | | | | |
|---|---|---|---|---|
| 2006/0073891 | A1* | 4/2006 | Holt | A63F 13/02 463/30 |
| 2010/0130280 | A1* | 5/2010 | Arezina | G07F 17/3206 463/20 |
| 2014/0226093 | A1* | 8/2014 | Schwartz | G02B 26/004 349/12 |

* cited by examiner

*Primary Examiner* — David L Lewis
*Assistant Examiner* — Robert E Mosser
(74) *Attorney, Agent, or Firm* — Mark A. Litman & Associates, P.A.

(57) ABSTRACT

An electronic gaming table executes player-versus-player playing card games. The gaming table has a display screen where at least one random virtual playing card is virtually delivered to individual player positions for each of the multiple players. The electronic gaming table includes the display screen, a processor associated with memory, player input controls and a playing card masking element at each player position. The playing card masking system at each player position is positioned over an individual position that is a portion of the display screen where the processor directs delivery of the at least one random virtual playing card virtual face down. The playing card masking system includes a three-dimensional element having a visible light transmissive line of sight between the individual position and a player at the individual player position, while excluding visible light transmission to player positions across from or adjacent to the individual player position.

10 Claims, 2 Drawing Sheets

ELECTRONIC GAMING TABLE WITH VIRTUAL PLAYING CARD MASKING SYSTEM

BACKGROUND OF THE INVENTION

1. Field of the Invention

The present invention relates to the field of table gaming, particularly electronic table gaming, and more particularly with respect to electronic gaming tables using virtual playing cards.

2. Background of the Art

Playing card games are generally played on a gaming table. The shape and design of tables often depends upon the nature of the underlying game. Typically, blackjack and baccarat have tables shaped like semi-ovals, with the dealer position at a straight side (or edge) of the table, and the players distributed around the curved side (or edge). Non-standard poker gaming events (e.g., Three-Card Poker® games, four card poker variants, Caribbean Stud Poker® game, etc.) where a player competes against a dealer are also played on semi-oval tables.

Competitive poker games, especially Texas Hold'Em and Omaha poker, have become very popular. In these games (and other player versus player poker games), players are distributed around a generally symmetrical table, with a non-playing dealer in a symmetrically centered dealing position. The players are evenly distributed around the continuously curved table (in the form of an oval or oval like structure). The continuous curve and symmetry connote that the individual player positions are equivalent, without a strategic advantage based on a position relative to other players.

In all player versus player games, at least some cards dealt to each player position are dealt face-down, intending for only the player receiving those cards from being able to view their own cards. In these games, the hidden cards (hold cards, down cards, etc.) must be kept private by individual players, or strategic advantages of each player are weakened or destroyed. For example, no player could bluff at a table if every player knew the suit and rank of all of that player's cards were. In casino table playing card games and in social playing card poker games, the players usually fold up corners of the cards to peek at their cards. In social games, players can physically lift playing cards from the table, bring them up to their face, and carefully screen their cards from others. Casinos do not allow lifting or removal of physical playing cards for numerous security reasons, avoiding circumstances where cards could be switched, cards could be marked, or cards could be viewed by players behind the card holder.

In recent years, strides have been made towards electronic gaming tables for playing card games. These electronic gaming tables may also be designed and tailored for the specific types of games executed on them, adding to the ambiance of a standard gaming table for the individual types of playing card games. These tables have been provided with many variations, as shown by US Published Patent Application Documents Nos. 20050090304; 20060055114; 2006005082; 2006005083; 2006005084; 2006005085; 2006005086; 2006005087; 2006005088; 2006005089; 2006005090; 2006005091; 20060050892; 2006005093; 20060066052; 20060068498; 2006006864; 2006006865; 2006006866; 2006006867; 2006006868; 2006006869; 2006006870; 2006006871; 2006006879; 2006006899 and 20090124314 (all assigned to PokerTek, Inc.

Other variations in poker-servicing electronic gaming tables are disclosed in U.S. Pat. Nos. 9,715,791; 9,640,027; 9,129,473; 8,348,747 8,926,421; 8,272,945 8,920,236; 8,684,360; 8,087,983; and 5,669,817.

US Published Patent Application Document No. 20050090304, in particular, evidences a system and method displays an electronic playing card to a player on a video display. The playing card has a back side and a front side. The system and method detect a triggering event and display at least a portion of the front side of the electronic playing card in response to the triggering event.

One consistent problem in the use of electronic gaming tables for poker and poker variants in which there is player-versus-player competition, is the ability to enable only single players to see playing cards without enabling competing players from seeing those same cards. For example, both Tarantino (U.S. Pat. No. 5,669,817) and US Published Patent Application Document No. 20050090304 is the fact that the image displayed to players can either been seen by adjacent or opposing position players when activated, even with the card owning player masking cards with their hands. Internal reflection within the electronic screen of the electronic table game or sloppy hand positioning can allow others to see a player's hand. U.S. Pat. No. 5,669,817 (Tarantino) describes a casino game table for card games such as poker includes a plurality of displays that operate to display dealt card representations in lieu of actual dealt cards. The game table includes a dealer position and a number of player positions. Each player position has a video display upon which is displayed, during game play, representations of game cards viewable substantially only by the associated player. The dealer position has a video display viewable by players and the dealer, upon which are displayed representations of cards dealt the dealer during game play, and cards of the dealer and participating players at the conclusion of game play. The dealer position includes game controls for initiating and maintaining game play. The dealer "deals" two cards to each player so indicating an intention to participate by button. This is done by the dealer depressing a "player cards" button. This commands the control processor to formulate the necessary cards and cause to be displayed on the video display unit of each participating player two card representations. The associated player may then "peek" at his/her cards by moving the sliding shield to uncover the display surface. If desired, so as not to let others see the card representations, the player may also hold a free hand over the portion of the screen uncovered by moving the sliding shield.

All documents cited in this application are incorporated in their entirety by reference. A quality solution to this problem is needed within the art.

SUMMARY OF THE INVENTION

An electronic gaming table executes player-versus-player playing card games. The gaming table has a display screen where at least one random virtual playing card is virtually delivered to individual player positions for each of the multiple players. The electronic gaming table includes the display screen, a processor associated with memory, player input controls and a playing card masking element at each player position. The playing card masking system at each player position is positioned over an individual position that is a portion of the display screen where the processor directs delivery of the at least one random virtual playing card virtual face down. The playing card masking system includes a three-dimensional element having a visible light transmissive line of sight between the individual position and a player at the individual player position, while excluding visible light transmission to player positions across from or adjacent to the individual player position. The player card masking system excludes visible light transmission to player positions across from or adjacent to the individual player position at least when the player at the individual player position activates revelation of at least a portion of the face of the playing card that is face down under the player card masking system.

DETAILED DESCRIPTION OF THE INVENTION

Figure 1:
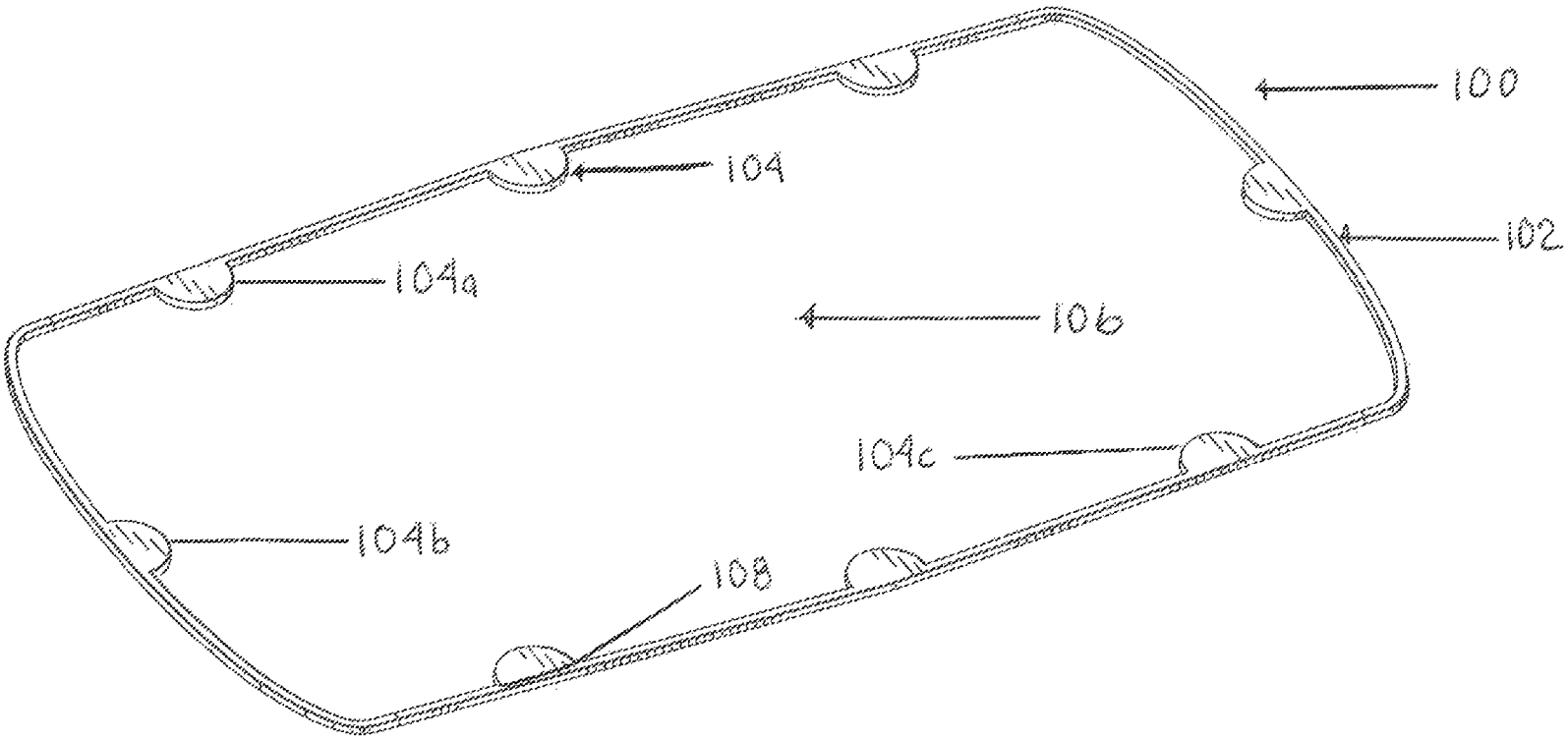
FIG. 1 shows a perspective view of a frame carrying eight virtual playing card masking systems or elements.

An electronic gaming table executes playing card games among multiple players (preferably player-versus-player gaming events such as poker and poker variants). The gaming table includes a display screen (either a continuous, segmented or discontinuous screen, with at least screens or screen areas flush with the game table surface) where at least one random virtual playing card is virtually delivered to individual player positions for each of the multiple players. The electronic gaming table generally includes the display screen, a processor (especially gaming processor associated with memory, image libraries, random number generator and accounting functions), player input controls (preferably a touchscreen, although buttons may be present on the playing surface of the game table) and a playing card masking element at each player position. The playing card masking system at each player position is positioned over an individual position that is a portion of the display screen where the processor directs delivery of the at least one random virtual playing card virtual face down.

The playing card masking system generally includes a three-dimensional element having at least a visible light transmissive line of sight between the individual position and a player at the individual player position, while having a static or active ability to exclude visible light transmission to player positions across from or adjacent to (including diagonally positioned from) the individual player position. The virtual player card masking system excludes visible light transmission to player positions across from or adjacent to or diagonal from the individual player position at least when the player at the individual player position activates revelation of at least a portion of the face of the playing card that is face down under the player card masking system.

The electronic gaming table may have forward-facing and side-facing sides of the playing card masking system which decrease light transmission upon player activation. The player activation may be actuated by player physical contact or player near-field communication or voice command, eye (retinal) direction, buttons at the player position or any other form of player input. The playing card masking system may be constructed from at least a polymeric or glass element. The playing card masking system may have at least translucent forward-facing and side-facing sides before activation and/or after activation. The electronic gaming table may include a playing card masking system comprises electronic optical glass (these are commercial materials and may comprises inorganic oxide glasses or polymeric sheet material) on the forward-facing and side-facing sides. One issue with the highly polished glass (or polymer) table top is reflection off that surface under the playing card masking element, where some information might be reflected back to a player way from the masking element position. This can be reduced in impact by having a lower edge or lower face of the masking element being provided with a non-reflective coating, pattern or surface, reducing any undesired reflection of image content. The addition of any surface or material to reduce or eliminate reflection off the underside of the masking element can be used on the reflective table top under the masking element or on the masking element itself. The addition of light-dispersing films or coatings may be use for example.

The electronic gaming table may have the virtual playing card masking system is physically supported at a distance between 0.5 and 5 millimeters over the display screen. This physical positioning is primarily provided so that the card masking systems (individually or as a complete set supported by a frame) onto an existing electronic gaming table adjacent a side of the table (the cushion) connecting the player positions. The individual or collective virtual playing card masking systems (the individual components) may be powered by battery, electric power feeds and the like, and power may be delivered from and through the frames. Support and orientation of the virtual playing card masking systems over the portions of the display screen where virtual playing cards are delivered face-down to individual player positions may be provided by the frame itself, but bumpers or legs (particular along edges of the virtual playing card masking systems may provide stabilizing support. These bumpers or legs may be polymeric, ceramic, or fabric (felt) to avoid scratching of the table display surface as well as to stabilize the virtual playing card masking systems.

A method of executing a playing card game among multiple players uses the above described gaming table with the virtual playing card masking systems. Virtual playing cards are displayed by computer direction onto the display screen, with at least one random virtual playing card delivered to individual display areas at an individual player position for individual ones of the multiple players being covered by a physical playing card masking system supported by the electronic gaming table, wherein the at least one random virtual playing card is delivered to the individual player position with its virtual face down, and is masked through forward-facing sides and side-facing sides of the player masking system.

The virtual face of the at least one random virtual playing card is revealed to the player position by player position activation without revealing the virtual face along a line of sight to player positions across from or adjacent to the individual player position. The activation is performed without revealing the virtual face along a line of sight to player positions across from or adjacent to the individual player position is effected by physical contact by the individual player or near-field communication contact by the individual player with the physical playing card masking system or a touch-screen capability on the display screen. The line of sight to player positions across from or adjacent to the individual player position is masked by at least optical impairing translucency in the physical playing card masking system.

FIG. 1 shows a perspective view of a system 100 including a frame 102 carrying eight virtual playing card masking systems or elements e.g., 104). The frame 102 is fitted to an electronic gaming table (not shown) where its surface would be seen through open area 106. Considering the system 100 from the perspective of a player position having the virtual playing card masking system or element 104, an adjacent virtual playing card masking element 104*a*, a perpendicular virtual playing card masking element 104*b* and diagonally positioned virtual playing card masking element 104*c* are shown. A connection line 108 is shown where a virtual playing card masking element attaches to the frame 102. The connection line 108 may be a fitted seem, an abutment line, or a hinge. An electrical power line (not shown) may be within or along the frame 102 where power is needed for the virtual playing card masking elements.

Figure 2:
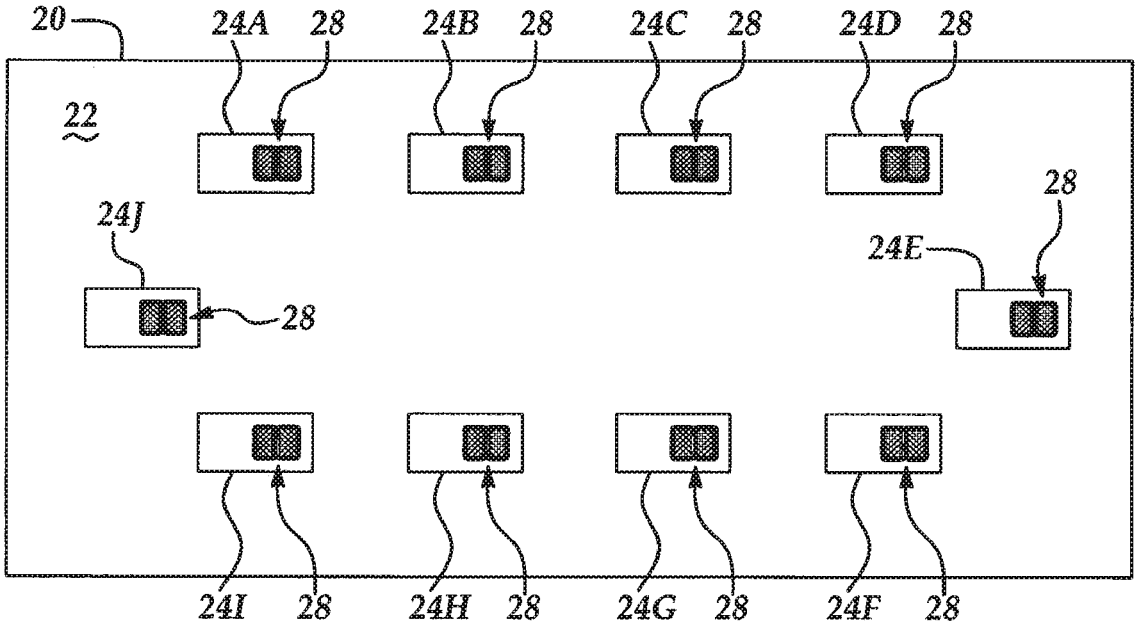
FIG. 2 is a (PRIOR ART) simplified diagram of a table top of electronic poker tables according to an embodiment of the present invention.
Figure 3:
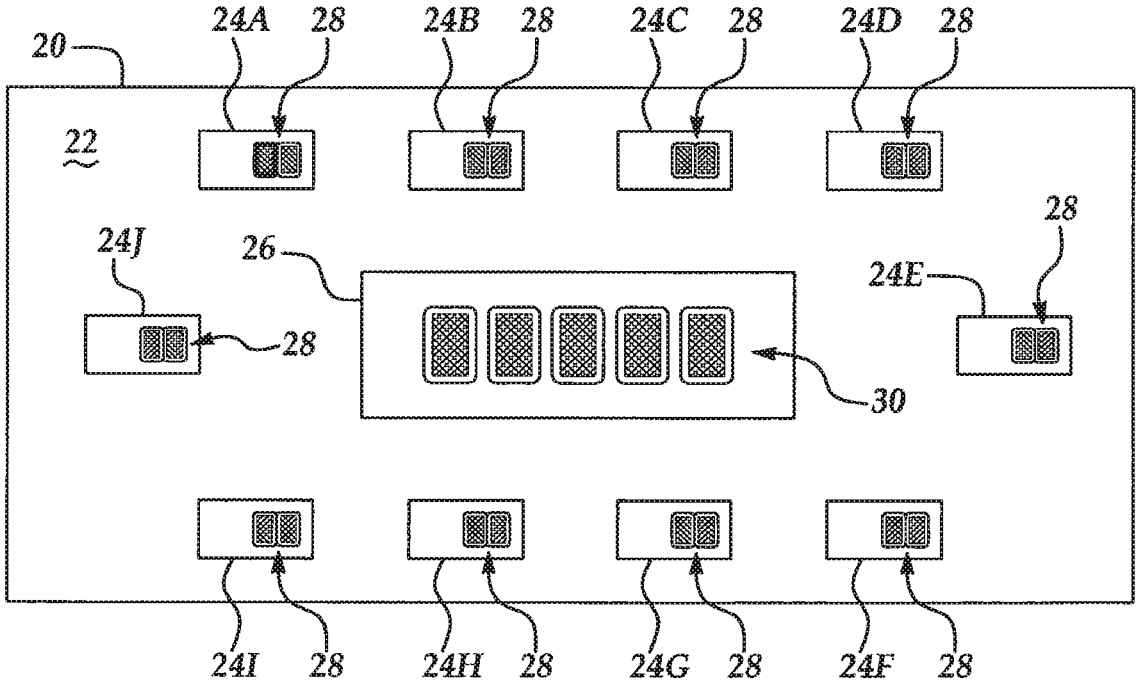
FIG. 3 is a simplified (PRIOR ART) diagram of a table top of electronic poker tables of according to another embodiment of the present invention.

A simple representative layout of a PRIOR ART table top 20 of the poker tables 18, according to embodiments of the present invention to which may be added the virtual playing card masking systems are shown in FIGS. 2 and 3, respectively.

In the top view of the table top 20 shown in FIG. 2, the table top 20 includes a playing surface 22 and a plurality of electronic player interaction areas 24. In the illustrated embodiment, the poker tables 18 are able to seat a maximum of ten players at a time, and thus, includes ten electronic player interaction areas 24A-24J.

In the top view of the table top 20 shown in FIG. 3 (in which like elements are labeled with the same reference numbers), the table top 20 includes a playing surface 22 and a plurality of electronic player interaction areas (EPIA) 24. In the illustrated embodiment, the poker tables 18 are able to seat a maximum often players at a time, and thus, includes ten electronic player interaction areas 24A-24J. The table top 10 also includes a central or common display area (CDA) 26.

In one embodiment, the individual electronic player interaction areas 24A-24J are used to convey game information directly to a player assigned to a specific player interaction area 24A-24J and to implement a player user interface (see below) to effectuate interaction or input from the player. The central or common display area 26 is used to display information to all of the players.

For example in one embodiment, the system 10 is used to play the version of poker known as Texas Hold'em or Omaha Poker. In Texas Hold'em, each player is dealt a number of cards, e.g., two cards, face down. These are known as a player's "hole" cards 28. A number of cards, e.g., three or five, are dealt face-up and displayed in the common display area 26. These are known as the common cards 30. A player's hand, thus, consists of the player's hole cards 28 and the common cards 30. Whichever player's hand makes the highest poker hand is the winner of that round or hand of poker.

In one aspect of the present invention, the hole cards 28 are displayed face-down on the respective electronic player interaction area 24 and the common cards are displayed in the central display area 26. The hole cards 28 are displayed at a first predetermined ratio and the common cards 30 are displayed at a second predetermined ratio. The first and second predetermined ratios may be expressed as a ratio of a standard size playing card or a predetermined default size. In one embodiment, the first and second ratios are the same. In another embodiment, the first and second ratios are different. For example, the first and second ratios may be defined such that the common cards 30 are displayed larger than the hole cards 28.

Referring to other options that might be available in an electronic gaming table configured for implementation of embodiments of wagering games in accordance with this disclosure where the virtual playing card masking may be overlain onto this system. The gaming table may be a physical article of furniture around which participants in the wagering game may stand and on which any physical objects used for administering and otherwise participating in the wagering game may be supported, positioned, moved, transferred and otherwise manipulated. For example, the gaming table may include a gaming surface on which the physical or virtual objects used in administering the wagering game (lammers, tokens, buttons) may be located. The gaming surface may be, for example, be a virtual image of a felt fabric covering a padded hard surface of the table, and a design, conventionally referred to as a "layout," specific to the wagering game being administered may be virtually printed on the gaming surface. For example, the gaming surface may include designated areas for player positions; areas in which one or more of virtual player cards or community cards may be dealt; areas in which wagers may be accepted; areas in which wagers may be grouped into virtual pots; and areas in which rules, paytables, and other instructions related to the wagering game may be displayed. As a specific, nonlimiting example, the gaming surface may be configured as shown for any poker game in a player versus player system. In some embodiments, the gaming table may include a display area separate from the gaming surface. The display area may be configured to face players, prospective players, and spectators and may display, for example, rules, paytables, real-time game status, such as wagers accepted and cards dealt, historical game information, such as amounts won, amounts wagered, percentage of hands won, and notable hands achieved, and other instructions and information related to the wagering game. The display area may be a physically fixed display, such as a poster, in some embodiments. In other embodiments, the display area may change automatically in response to a stimulus (e.g., may be an electronic video monitor).

The gaming table may include particular machines and apparatuses configured to facilitate the administration of the wagering game. For example, the gaming table may include one or more virtual card-handling devices (a virtual shoe, a virtual tray, a virtual shuffler or a virtual dealer). The virtual card-handling device may be, for example, a virtual shoe from which virtual cards from one or more virtual decks of playing cards may be withdrawn, one at a time or in packets. Such a virtual card-handling device may include a virtual housing in which virtual cards are located, a virtual opening from which virtual cards are removed, and a virtual card-presenting mechanism configured to continually present new random virtual cards for withdrawal from the shoe. The card-handling device may be, for example, a shuffler configured to randomly order virtual cards from one or more decks of virtual playing cards and present randomized cards for use in the wagering game. Such a virtual card-handling device may include a housing, a virtual shuffling mechanism configured to shuffle cards, and virtual card inputs and virtual card outputs (e.g., trays). The virtual card-handling device may also be, for example, a combination virtual shuffler and shoe in which the output for the virtual shuffler is a virtual shoe. In some embodiments, the deck or decks of virtual playing cards used may be standard, 52-card decks or non-standard decks with additional or fewer cards. In other embodiments, the deck or decks used may include cards, such as, for example, jokers (e.g., two jokers), wild cards, bonus cards, etc.

The gaming table may include a virtual chip rack configured to facilitate the acceptance of wagers, the transfer of lost wagers to the house, and the exchange of monetary value for virtual wagering tokens (e.g., virtual poker chips). For example, the virtual chip rack may include a series of virtual token support rows, each of which may support tokens of a different type (e.g., color and denomination). In some embodiments, the gaming table may include a virtual deposit for virtual money that is accepted in exchange for virtual wagering tokens.

When administering a wagering game in accordance with embodiments of this disclosure, a virtual dealer may receive virtual money (e.g., cash, stored credit, account credit, wagers into a jackpot) from a player in exchange for wagering tokens. The dealer may deposit the money in the virtual deposit and transfer virtual or physical wagering tokens to the player. The physical or virtual dealer may accept one or more initial wagers (e.g., antes, calls, raised and other wagers) from the player, which may be reflected by the dealer permitting the player to place one or more physical or virtual wagering tokens or other wagering elements (e.g., cash) within designated areas on the gaming surface associated with the various wagers of the wagering game. Once initial wagers have been accepted, the dealer may remove virtual cards from the virtual card-handling device and virtually position them within designated areas on the gaming surface (over which the physical card masking system of the present technology would be placed), which may designate the virtual cards 206 for use as individual player virtual cards, or, in some embodiments, virtual community cards, in accordance with game rules. After dealing the virtual cards, any additional wagers (e.g., draw bets) may be accepted, which may be reflected by the dealer permitting the player to place one or more (physical or virtual) wagering tokens within designated areas on the virtual gaming surface associated with the various wagers of the wagering game. In some embodiments, a player may fold, which may result in the dealer collecting at least one of the wagering tokens from that player and transferring it to the house, which may be reflected by the wagering token being returned to the chip rack. The dealer may perform any additional card dealing and rounds of betting permitted in the wagering game. Finally, the dealer may resolve the wagers, award winning wagers to the players, which may be accomplished by giving wagering tokens from the (physical or virtual) chip rack to the players, and transfer losing wagers to the house, which may be accomplished by (physically or virtually) moving wagering tokens from the players to the (physical or virtual) chip rack.

What is claimed:

1. An electronic gaming table for execution of playing card games among multiple players comprising a display screen where at least one random virtual playing card is virtually delivered to individual player positions for each of the multiple players, the electronic gaming table comprising the display screen, a processor associated with memory, player input controls and a playing card masking element at each player position, wherein:

the playing card masking system at each player position is physically supported at a distance between 0.5 and 5 millimeters over the display screen at an individual position that is a portion of the display screen where the processor directs delivery of the at least one random virtual playing card virtual face down;

the playing card masking system comprising a three-dimensional element having at least a visible light transmissive line of sight between the individual position and a player at the individual player position, while excluding visible light transmission to player positions across from or adjacent to the individual player position; and wherein the player card masking system excludes visible light transmission to player positions across from or adjacent to the individual player position at least when the player at the individual player position activates revelation of at least a portion of the face of the playing card that is face down under the player card masking system, wherein forward-facing and side-facing sides of the playing card masking system decrease light transmission upon player activation.

2. The electronic gaming table of claim 1 wherein player activation is able to be actuated by player physical contact or player near-field communication.

3. The electronic gaming table of claim 1 wherein the playing card masking system comprises a polymeric or glass element.

4. The electronic gaming table of claim 3 wherein the playing card masking system has translucent forward-facing and side-facing sides before activation or after activation.

5. The electronic gaming table of claim 4 wherein the playing card masking system comprises electronic optical glass on the forward-facing and side-facing sides.

6. The electronic gaming table of claim 4 wherein the virtual playing card masking system is hinged to a frame surrounding the display screen.

7. A method of executing a playing card game among multiple players on an electronic gaming table in which virtual playing cards are displayed by computer direction onto a display screen, with at least one random virtual playing card delivered to individual display areas at an individual player position for individual ones of the multiple players being covered by a physical playing card masking system supported by the electronic gaming table, wherein the at least one random virtual playing card is delivered to the individual player position with its virtual face down, and is masked through forward-facing sides and side-facing sides of the player masking system, wherein the physical playing card masking system is physically supported at a distance between 0.5 and 5 millimeters over the display screen at each individual player position.

8. The method of claim 7 wherein the virtual face of the at least one random virtual playing card is revealed to the player position by player position activation without revealing the virtual face along a line of sight to player positions across from or adjacent to the individual player position.

9. The method of claim 8 wherein activation without revealing the virtual face along a line of sight to player positions across from or adjacent to the individual player position is effected by physical contact by the individual player or near-field communication contact by the individual player with the physical playing card masking system or a touch-screen capability on the display screen.

10. The method of claim 9 wherein the line of sight to player positions across from or adjacent to the individual player position is masked by at least optical impairing translucency in the physical playing card masking system.

* * * * *